United States Patent [19]

Schaffer, Jr. et al.

[11] Patent Number: 4,917,490

[45] Date of Patent: Apr. 17, 1990

[54] BORESIGHT ALIGNMENT MEASURING APPARATUS AND METHOD FOR ELECTRO-OPTIC SYSTEMS

[75] Inventors: James R. Schaffer, Jr., Madison; Stephen K. Pitalo; Henry P. Lay, both of Huntsville, all of Ala.

[73] Assignee: The Boeing Company, Seattle, Wash.

[21] Appl. No.: 152,401

[22] Filed: Feb. 4, 1988

[51] Int. Cl.[4] ..... G01B 11/26

[52] U.S. Cl. ..... 356/152; 89/41.06; 250/341; 250/342; 434/4

[58] Field of Search ..... 250/341, 342; 356/153, 356/141, 152; 434/4; 89/41.06

[56] References Cited

U.S. PATENT DOCUMENTS

| | | | |
|---|---|---|---|
| 3,229,093 | 1/1966 | Trautvetter . | |
| 3,603,686 | 9/1971 | Paine | 356/152 |
| 3,857,042 | 12/1974 | LaGrange et al. . | |
| 3,943,360 | 3/1976 | Parkin . | |
| 4,021,662 | 5/1977 | Mimms . | |
| 4,037,959 | 7/1977 | Bumgardner . | |
| 4,087,689 | 5/1978 | Asawa . | |
| 4,139,769 | 2/1979 | McCrum et al. . | |
| 4,155,096 | 5/1979 | Thomas et al. | 356/152 X |
| 4,260,254 | 4/1981 | Braun . | |
| 4,298,280 | 11/1981 | Harney | 356/5 |
| 4,311,384 | 1/1983 | Keene | 356/152 |
| 4,326,799 | 4/1982 | Keene et al. | 356/152 |
| 4,342,514 | 8/1982 | Mathews | 356/5 |
| 4,346,992 | 8/1982 | Schwartz . | |
| 4,349,838 | 9/1982 | Daniel | 356/152 X |
| 4,386,848 | 6/1983 | Clendenin et al. | 356/152 X |
| 4,576,480 | 3/1986 | Travis | 356/152 |
| 4,626,685 | 12/1986 | Pitalo et al. . | |
| 4,632,521 | 12/1986 | Korsch . | |

*Primary Examiner*—Thomas H. Tarcza
*Assistant Examiner*—Linda J. Wallace
*Attorney, Agent, or Firm*—Finnegan, Henderson, Farabow, Garrett & Dunner

[57] ABSTRACT

An apparatus and method are provided for static and dynamic testing of the boresight alignment of an electro-optic system, the system having a line-of-sight sensor responsive to first radiation from a target for sensing the location of the target and setting the direction of a target vector to correspond to the location of the target, and having a line-of-sight illuminator for directing an illumination beam of second radiation at the located target. The apparatus comprises a main optic for receiving the second radiation from the electro-optic system and focusing the second radiation about a focal point in a focal plane substantially perpendicular to a principal radiation path. The main optic includes a primary reflector for reflecting the first and the second radiations between the electro-optic system and a subreflector zone, a secondary reflector positioned in the subreflector zone and spaced from the primary reflector for reflecting the first and second radiations between the primary reflector and the focal plane along the principal radiation path. The apparatus comprises a first radiation source for generating a target beam of the first radiation and for directing the target beam along the principal radiation path sequentially to the secondary and primary reflectors and to the sensor of the electro-optic system, thereby causing the sensor to set the direction of the target vector in substantial correspondence with the target beam, and a detector responsive to the second radiation for detecting the location of the illumination beam relative to the location of the target vector.

23 Claims, 8 Drawing Sheets

BORESIGHT ALIGNMENT MEASURING APPARATUS AND METHOD FOR ELECTRO-OPTIC SYSTEMS

BACKGROUND OF THE INVENTION

1. Field of the Invention

The invention relates to electro-optic system test equipment and, more specifically, to test equipment for measuring the boresight alignment of electro-optic systems having a line-of-sight sensor for detecting and locating a target and a line-of-sight illumination device for illuminating or designating the target.

2. Description of the Related Art

Recent improvements in military and commercial electro-optic ("E-O") systems have been made by incorporating two or more major functions into a single piece of equipment. For example, a military E-O system might incorporate a line-of-sight sensor subsystem such as a forward looking infrared sensor ("FLIR") for detecting and locating a target in darkness, and a line-of-sight illumination subsystem such as a laser designator for illuminating or designating the target.

The FLIR is a passive device capable of identifying the location of a target in its line-of-sight viewing aperture based on the infrared signature of the target. For convenience here, the FLIR is assumed to have a target vector which the FLIR directs to the target. The target vector is an imaginary line (a mathematical construction) extending from the center of the FLIR aperture to the center of the target signature (centroid of the signature beam) which is used to represent the physical geometric location of the target relative to the FLIR.

The laser designator is an active device that generates and projects a laser illumination beam onto the target identified by the FLIR, where laser illumination beam as used herein is not restricted to a particular band of wavelengths. The direction of the illumination beam is defined by an imaginary line extending from the center of the laser designator's output aperture and running along the centroid of the beam. The laser designator includes a steering mechanism for steering the illumination beam to the target and maintaining the beam on the target during movements of the target relative to the E-O system.

The relative mounting positions of the FLIR and laser designator on the E-O system are usually offset. This offset can be effectively eliminated and the target vector and illumination beam can be made concentric, for example, by placing a beam-splitter at or near the FLIR aperture and directing the illumination beam to the beamsplitter with a mirror. For E-O system designs in which the FLIR and laser designator offset is maintained, this offset is typically sufficiently small relative to the target range that the target vector and the illumination beam can be assumed to be coincident, as may the FLIR and laser designator apertures. The boresight alignment of the E-O system as that term is used here refers to this line of coincidence between the target vector and the illumination beam expressed in angular terms.

The angular alignment of the FLIR target vector and the illumination beam is referred to here as boresight alignment. Boresight alignment is essential for proper operation of multispectral E-O systems as described above, regardless of their specific design, since the laser designator will accurately illuminate the target located by the FLIR only if the E-O system is properly boresight aligned.

The FLIR and laser designator, however, typically operate on different physical principles, most often in different bands or regions of the electromagnetic spectrum. Typical FLIR night vision systems cover the 8- to 12-micron (micrometer) wavelength band, while typical laser target designators radiate at about one micron. Techniques, designs and materials used to manipulate radiation in these different bands can differ significantly. These factors have led to difficulty in designing equipment to test the boresight alignment of such E-O systems.

In the past, boresight alignment was typically monitored and maintained by measuring the FLIR target vector and the position of the laser illumination beam with respect to a common physical or structural component of the E-O system or its supporting platform. The location of the component provided a common reference point from which the positions of the target vector and illumination beam could be independently measured and then compared. This design approach was generally unsatisfactory in practice since it was difficult to maintain necessary physical tolerances throughout system manufacture and during operation. For example, operational conditions for such systems typically include error-inducing motion and structural vibrations as well as environmental effects such as large variations in temperature, pressure and humidity.

One example of a known system for measuring FLIR-to-laser boresight alignment provides a replaceable film target through which the laser designator burns a hole. The FLIR is then focused on the film while the hole is back-lighted with long-wavelength radiation detectable by the FLIR. This design has a number of drawbacks. For example, its accuracy is not only a direct function of FLIR-to-laser alignment, but also of the dimensions of the burned hole and the operational characteristics of the laser designator. Furthermore, the equipment is only suitable for static testing since it is large, bulky and susceptible to motion.

Another example of a known FLIR-to-laser boresight alignment tester is specifically classed as an "operational level" flight line tester and was designed to test the E-O system, including its FLIR-to-laser boresight alignment, of a particular aircraft. The E-O system of the aircraft includes FLIR sensor and laser designator subsystems having apertures which are offset from one another. Aperture dimensions and center-to-center spacing between apertures are fixed. The tester has separate optical collimators for testing each subsystem, and separate emitters and detectors to accomplish various tests with each collimator. Among the detectors is a quadrature laser detector to establish FLIR-to-laser boresight. This tester measures boresight alignment while accomodating the FLIR-to-laser offset.

This tester design also has a number of drawbacks due largely to its specific applicability to a particular aircraft. For example, the alignment of the quadrature laser detector to the FLIR test collimator boresight must be set in the factory, and any variation of alignment due to tester handling or aging requires realignment at the factory or depot. In addition, the tester must be firmly attached to the E-O system under test and cannot accommodate relative motion between the E-O system and the tester.

Other known E-O system boresight alignment test equipment designs include a family of testers designed and developed by the assignee of the present invention. An example of this family of testers is disclosed in U.S. Pat. No. 4,626,685, which provides a multispectral collimator having reflective diamond-machined optical elements for producing a target signature, and refractive or reflective optical elements for directing the laser beam of a laser designator to one or more detector elements.

Although this design provided a number of improvements and advantages over other known systems, it also was designed for static operation and allowed no relative movement between tester and the E-O system under test.

Accordingly, it is an object of the invention to provide an apparatus and method for static and dynamic testing of the boresight alignment of an E-O system.

It is also an object of the invention to provide an apparatus and method for static and dynamic testing the boresight alignment of an E-O system which do not require a common physical reference point on the E-O system.

It is further an object of the invention to provide an apparatus and method for static and dynamic testing the boresight alignment of an E-O system which operate independently of laser designator operational characteristics other than pointing.

It is still further an object of the invention to provide an apparatus and method for static and dynamic testing the boresight alignment of an E-O system which are adaptable to a wide range of E-O system designs.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described here, an apparatus and method are provided for static and dynamic testing of the boresight alignment of an E-O system having a line-of-sight sensor responsive to first radiation from a target for sensing the location of the target and setting the direction of a target vector to correspond to the location of the located target, and a line-of-sight illuminator for directing an illumination beam of second radiation at the located target, the boresight alignment being the extent to which the target vector and the illumination beam have achieved a predetermined angular relationship.

The apparatus of the invention comprises a main optic optically coupled to the electro-optic system and aligned with a principal radiation path for receiving the second radiation from the electro-optic system and focusing the second radiation about a focal point in a focal plane substantially perpendicular to the principal radiation path, the main optic including primary reflecting means for reflecting the first and the second radiations between the E-O system and a subreflector zone, and secondary reflecting means positioned in the subreflector zone and spaced from the primary reflecting means for reflecting the first and second radiations between the primary reflecting means and the focal plane along the principal radiation path. The apparatus further includes first radiation source means positioned effectively in the principal radiation path for generating a target beam of the first radiation and for directing the target beam along the principal radiation path sequentially to the secondary reflecting means, to the primary reflecting means, and to the sensor of the E-O system, the target beam causing the sensor to set the direction of the target vector in substantial correspondence with the target beam; and detecting means positioned effectively in the focal plane and in the principal radiation path and responsive to the second radiation for detecting the location of the illumination beam relative to the location of the target vector.

Preferably, the first radiation source means includes a first radiation source, such as infrared blackbody source, and the detecting means includes a detector matrix responsive to the illumination beam of second radiation. The infrared blackbody source and the detecting means may be spaced from the principal radiation path, in which case beam reflecting means, such as mirrors or beamsplitters, may be used to appropriately guide the radiation beams.

The apparatus of the preferred embodiment includes internal alignment means for aligning the radiation source means with the detecting means, the internal alignment means including internal alignment radiation source means effectively positioned in the principal radiation path for generating an internal alignment beam of a third radiation to which the detecting means responds, and for directing the internal alignment beam substantially along the principal radiation path sequentially to the secondary reflecting means and to the primary reflecting means, and retro-reflector means positioned substantially in the principal radiation path and preferably adjacent to the secondary reflecting means for receiving the internal alignment beam from the primary reflecting means and reflecting the internal alignment beam sequentially to the primary reflecting means, to the secondary reflecting means, and substantially along the principal radiation path to the detecting means.

The internal alignment beam of the preferred embodiment provides an important advantage of the present invention over known devices, namely, it provides a reference measurement for the detecting means to establish the precise location of the target beam projected to the FLIR of the E-O system independent of physical or structural elements of the tester head or E-O system. This feature is in part attributable to the correspondence between the optical path followed by the internal alignment beam within the tester head and the optical paths followed by the outgoing target beam and the incoming illumination beam.

The method of the present invention comprises generating a target beam of the first radiation in a focal plane and directing the target beam along the principal radiation path substantially perpendicular to the focal point to a secondary reflecting zone, reflecting the target beam at the secondary reflecting zone to a primary reflecting zone, and reflecting and collimating the target beam at the primary reflecting zone to the sensor of the E-O system. The target beam causes the sensor to set the direction of the target vector in substantial correspondence with the target beam. The method further includes reflecting the illumination beam of the E-O system at the primary reflecting zone to the secondary reflecting zone, reflecting the illumination beam at the secondary reflecting zone to a detector location in the focal plane along the principal radiation path, and detecting the location of the illumination beam relative to the location of the target vector at the detector location.

The preferred method includes generating an internal alignment beam of a third radiation to which the detector responds, the internal alignment beam including an image that represents the location of the target beam, and directing the internal alignment beam substantially along the principal radiation path sequentially to the secondary reflecting zone, to the primary reflecting zone, to a retro-reflecting zone, to the primary reflecting zone, to the secondary reflecting zone, and substantially along the principal radiation path to a location on the same detector as used to locate the illumination beam of second radiation; and detecting the location of the image contained in the internal alignment beam at the detector location to establish the location of the target beam with respect to the detector. The method thus provides a relative measurement that establishes an alignment reference between internal apparatus regardless of motion or of the behavior of the E-O system under test.

BRIEF DESCRIPTION OF THE DRAWINGS

The accompanying drawings, which are incorporated in and constitute a part of the specification, illustrate a presently preferred embodiment and method of the invention and, together with the general description given above and the detailed description of the preferred embodiment and method given below, serve to explain the principles of the invention. Of the drawings.

DETAILED DESCRIPTION OF THE PREFERRED EMBODIMENT AND METHOD

Figure 1:
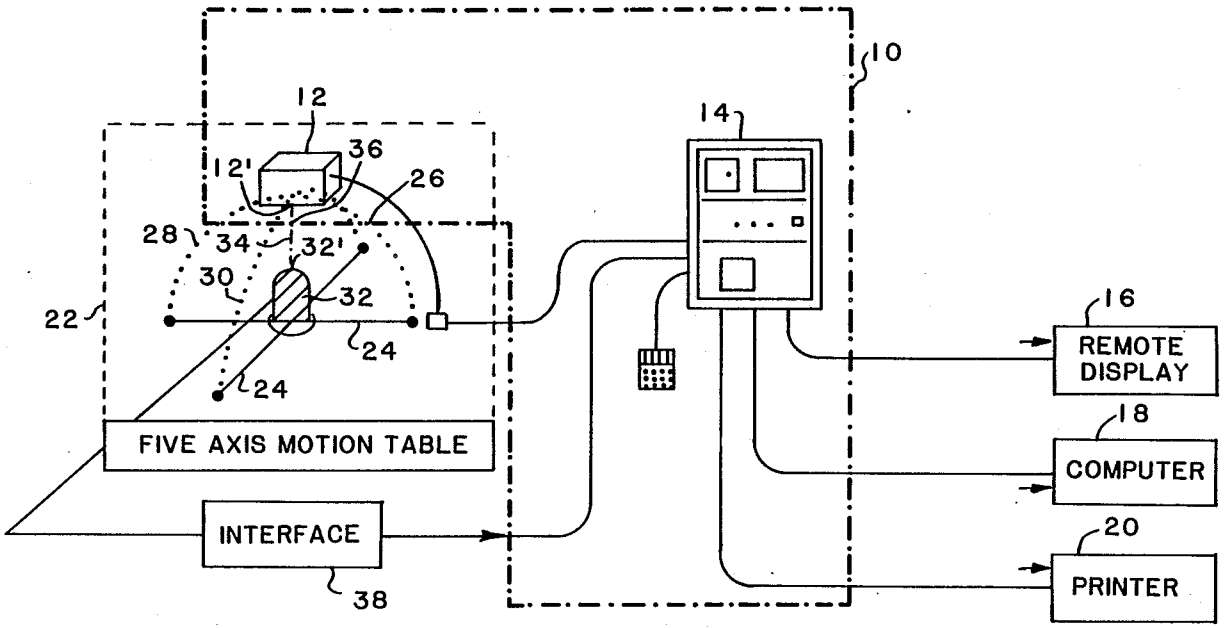
FIG. 1 shows the boresight alignment measuring apparatus of the preferred embodiment of the invention mounted on and coupled to a five-axis motion table.

Reference will now be made in detail to the presently preferred embodiment and method of the invention as illustrated in the accompanying drawings, in which like reference characters designate like or corresponding parts throughout the several drawings.

The preferred embodiment and method of the invention are intended to statically and dynamically test the boresight alignment of an E-O system having a line-of-sight sensor responsive to first radiation from a target for sensing the location of the target and setting the direction of a target vector to correspond to the location of the located target, and a line-of-sight illuminator for directing an illumination beam of second radiation at the located target.

For illustrative purposes, the line-of-sight sensor is assumed here to be a FLIR responsive to infrared radiation emanating from the target at a wavelength of, e.g., 8- to 12-microns, and in accordance with Planck's distribution. The FLIR is capable of sensing a target with a high degree of directionality based on the infrared signature of that target. The FLIR designates the location of the target by producing an imaginary target vector directed from the center of the FLIR's viewing aperture to the center of the target's infrared signature.

Also for illustrative purposes, the line-of-sight illuminator is assumed here to be a laser designator having a highly-directional illumination beam of a second radiation, for example, at a one-micron wavelength.

Boresight alignment as used here refers to the extent to which the target vector of the FLIR and the illumination beam of the laser designator have achieved a predetermined angular relationship, for example, zero degrees where the beams are essentially concentric when properly aligned, as described above.

The preferred embodiment and method are adapted to operate in three modes. The first mode is a target projection mode in which a target signature or target beam is generated and projected toward the sensor of the E-O system. This causes the sensor to set the direction of the target vector (to point itself) at a known position, i.e., the point from which the target signature originates. Thus, during the target projection mode, the target vector of the E-O system sensor is fixed or set at a known position on the apparatus of the invention, even if the E-O system is in motion relative to the apparatus.

The E-O system responds to the identification and location of the target by causing the laser designator to project an illumination beam to illuminate the target in response to the target vector of the sensor. The second mode of the invention, referred to here as the boresight measurement mode, detects the position of the illumination beam. This information is compared with the location of the target vector, established during the third mode of operation, to obtain a measurement of the boresight alignment of the E-O system.

The apparatus of the preferred embodiment and method operate in a third mode, referred to here as the internal alignment mode, during which detecting means for detecting the illumination beam are calibrated or set relative to the target signature projection location. The internal alignment mode accomplishes this function by generating and projecting an internal alignment beam of a third radiation from a position in the focal plane of the main optic along the path of the target beam projected to the FLIR of the E-O system. The internal alignment beam is collimated by the main optic and retro-reflected back through the main optic. This causes the internal alignment beam to be focused into the focal plane at the detecting means. The detecting means senses the location of a spot image contained in the internal alignment beam and stores this measurement as a reference value indicative of the centroid of the target beam. If the bore-sight alignment of the E-O system is correctly achieved, the E-O system will direct the illumination beam in correspondence with this reference location. Since the internal alignment beam sets the reference value or location in the detecting means, no mechanical movement or adjustment of the position of the detecting means need occur. The internal alignment mode thus provides the equivalent of a common physical reference point between target signature projection (target projection mode) and illumination beam detection (boresight measurement mode) without using a part of the E-O system itself as a reference.

The apparatus of the preferred embodiment of the invention, indicated generally by reference numeral 10, is shown in an operational configuration in FIG. 1. This preferred embodiment includes a tester head 12 and a controller 14, as described in detail below. Controller 14 may include associated peripheral devices such as a remote display 16, computer 18, and printer 20.

Tester head 12 is mounted on a five-axis flight motion simulation system 22, conventionally known as a motion table or gimbal table, having a roll-pitch-yaw plane 24 and an outer gimbal azimuth-elevation arm 26. Specifically, tester head 12 is preferably mounted on outer gimbal arm 26 at the intersection of an azimuth support 28 and an elevation support 30. Tester head 12 has a test aperture 12' which is positioned toward plane 24 of motion table 22.

An E-O system 32 to be tested is mounted at the center of plane 24 of motion table 22, preferably directly below tester head 12 as shown in FIG. 1, for testing using the preferred apparatus and method of the invention. E-O system 32 includes a FLIR and a laser designator which are postioned adjacent an optical aperture 32' through which the FLIR and laser designator transmit and receive radiation. E-O system 32 is positioned on plane 24 so that optical aperture 32' faces test aperture 12' of tester head 12, thus enabling the FLIR to sense infrared radiation emanating from test aperture 12' and enabling the laser designator to illuminate test aperture 12'.

E-O system 32 may be assumed to have an optical axis 34 which extends through optical aperture 32' and corresponds to a FLIR viewing direction of zero degrees and a laser designator angle of zero degrees, axis 34 extending directly outward from optical aperture 32'. Tester head 12 may also be assumed to have an optical axis 36 extending through test aperture 12' directly outward from test aperture 12'. Motion table 22 has a reference position wherein roll, pitch and yaw of plane 24 are zero and the intersection of azimuth and elevation support 28 and 30 are at zero azimuth and elevation. At this reference position, optical axis 34 of E-O system 32 is aligned with optical axis 36 of tester head 12. The FLIR of E-O system 32 is adapted to sense targets at several miles range and within several degrees of optical axis 34. Accordingly, motion table 22 can move E-O system 32 relative to tester head 12 so that the ability of the FLIR to detect targets over its entire angular viewing range of several degrees, and the ability of the laser designator to illuminate the targets at these various angles can be tested. The ability of E-O system 32 to dynamically track and illuminate moving targets can also be tested with this configuration. An interface box or device 38 can be used to couple E-O system 32 to controller 14 so that information about E-O system operation such as internal FLIR and laser designator commands and responses can be provided to controller 14 during a test.

Figure 2:
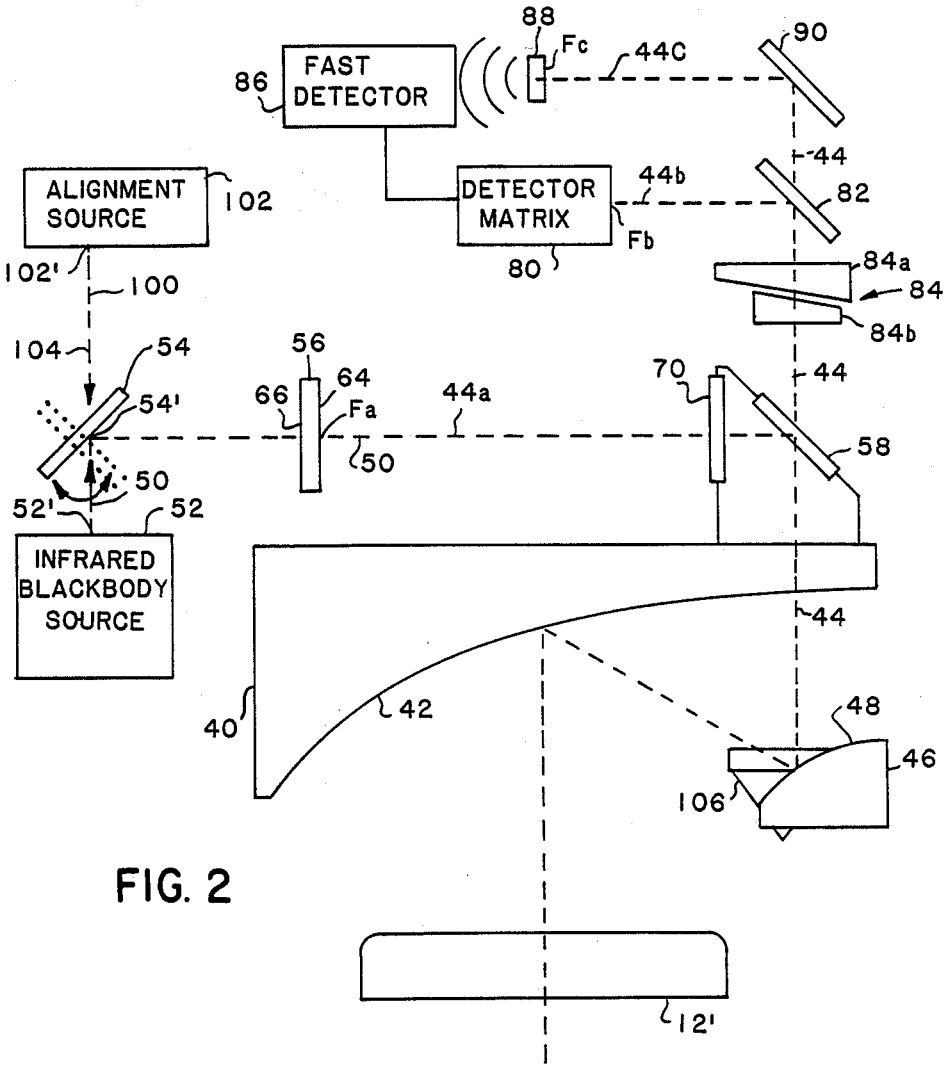
FIG. 2 is a schematic diagram of principal internal components of the tester head of the apparatus shown in FIG. 1.
Figure 3:
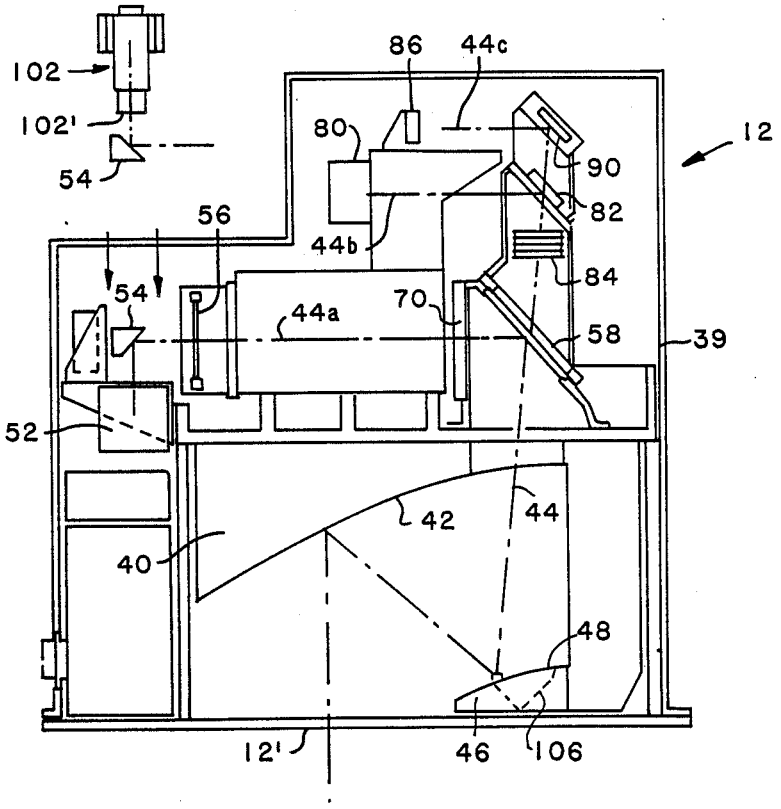
FIG. 3 is a diagram of the tester head of the preferred embodiment shown in FIGS. 1 and 2 which illustrates its internal arrangement.

The internal structure of tester head 12 in accordance with the preferred embodiment is shown in FIGS. 2 and 3. FIG. 2 is a schematic diagram of selected internal components of tester head 12 which illustrates the operation of the apparatus. FIG. 3 shows the arrangement of these internal components of tester head 12 within a housing 39.

The preferred embodiment uses a single optical assembly within tester head 12 to project the target beam during the target projection mode and to receive the illumination beam during the boresight measurement mode. Accordingly, tester head 12 includes primary reflecting means for reflecting the first and the second radiations, i.e., infrared radiation for the FLIR and monochromatic light for the laser designator, between E-O system 32 and a secondary reflecting zone. The primary reflecting means of the preferred embodiment includes a primary reflector 40, e.g., a mirror, having a reflective surface 42 capable of reflecting the first and second radiations.

Tester head 12 also includes secondary reflecting means positioned in the secondary reflecting zone and spaced from the primary reflecting means for reflecting the first and second radiations between the primary reflecting means and a principal radiation path 44. The secondary reflecting means comprises a secondary reflector 46, e.g., a mirror, having a reflective surface 48 capable of reflecting the first and second radiations.

Figure 4:
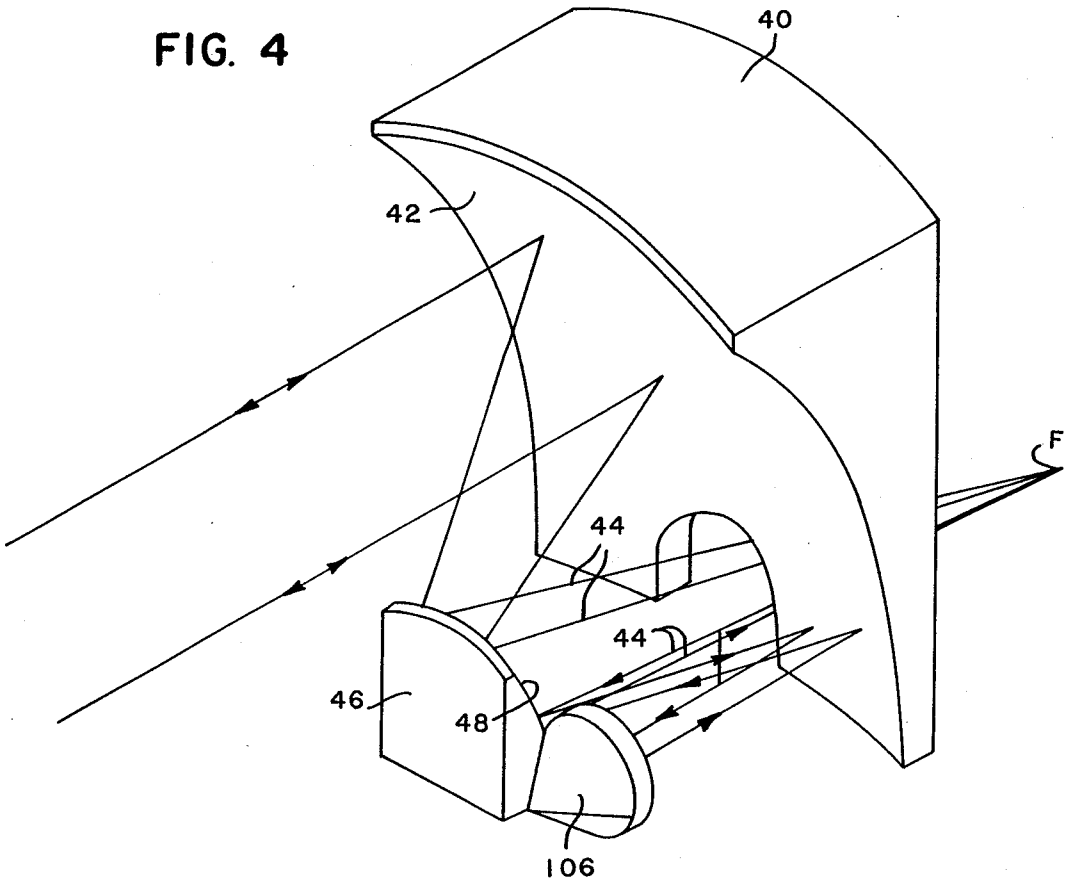
FIG. 4 shows a perspective view of the main optic of the preferred embodiment mounted in the tester head shown in FIGS. 2 and 3.

As shown in FIG. 4, primary reflector 40 and secondary reflector 46, collectively referred to here as the main optic, comprise a two-element optic adapted to receive collimated or beam radiation from E-O system 32 and focus it in a focal plane about a focal point F. The main optic performs this function provided the E-O system 32 is within the angular field of view of the detecting means as seen through the main optic. Since the angular range of E-O system 32 is on the order of several degrees, radiation travels between E-O system 32 and the focal plane along essentially a single path, i.e., principal radiation path 44. Principal radiation path 44 is actually a plurality of paths between points in the focal plane and on the surfaces of secondary reflector 46 and primary reflector 40, each point in the focal plane corresponding to an angle of radiation at surface 42 of primary reflector 40. The focal point F is a special case of radiation having an angle of zero degrees with respect to the two-mirror main optic. Thus, beam radiation emanating from E-O system 32 while tester head 12 is within the angular range of E-O system 32 is focused in a focal plane about focal point F by the main optic. This occurs with the illumination beam of the laser designator during the boresight measurement mode.

In similar fashion and in accordance with the well known principle of reciprocity in optics, radiation projected from a point source at focal point F will be collimated by the main optic and propagated outward as parallel radiation at zero degrees, filling test aperture 12'. Radiation from a broadened source about focal point F will fill aperture 12' with radiation having a corresponding distribution of angles. This occurs with the target beam during the target projection mode.

In accordance with the preferred embodiment, reflective surfaces 42 and 48 comprise highly-polished metallic mirrors such as gold coated, diamond-machined aluminum. Reflective surfaces 42 and 48 preferably have surface geometries corresponding to a concave paraboloid and a convex hyperboloid, respectively, each facing the other in a Cassegrain configuration.

Figure 5A:
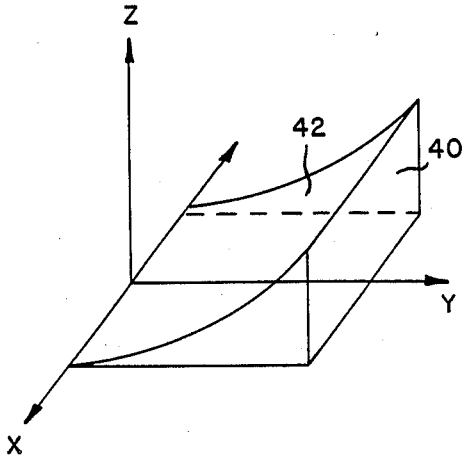
FIG. 5A shows the primary reflector of the main optic shown in FIG. 4.
Figure 5B:
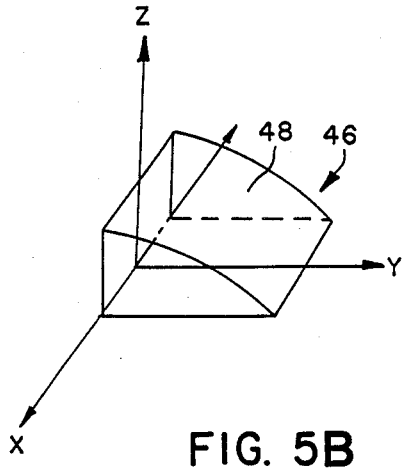
FIG. 5B shows the secondary reflector of the main optic shown in FIG. 4.

A specific embodiment of the main optic as described above has been constructed, an illustration of which is shown in FIGS. 4, 5A and 5B. Primary reflector 40 as shown in FIGS. 4 and 5A measures about 11 inches at its maximum width along the x-axis and about 15 inches at its maximum height along the y-axis. Reflective surface 42 has surface geometry $z_1$ along the z-axis according to $$z_1 = \frac{p^2/r_1^2}{1 + \sqrt{1 - (1 + \Delta_1)(p^2/r_1^2)}}$$

where $p^2 = x^2 + y^2$, $r_1 = -22.409$, $\Delta_1 = -1$, and x, y and $z_1$ are the three axes of a rectilinear coordinate system.

Secondary reflector 46 as shown in FIG. 5B measures about 6 inches at its maximum width along the x-axis and about 8 inches at its maximum height along the y-axis. Reflective surface 48 has surface geometry $z_2$ along the z-axis according to $$z_2 = \frac{p^2/r_2^2}{1 + \sqrt{1 - (1 + \Delta_2)(p^2/r_2^2)}}$$

where $p^2 = x^2 + y^2$, $r_2 = -7.272$, $\Delta_2 = -1.6112155$, and x, y and z are the three axes of a rectilinear coordinate system.

With reference to FIG. 4, principal radiation path 44 lies between secondary reflector 46 and focal point F. In accordance with well known principles of optics, principal radiation path 44 and focal point F can be moved to various alternate locations while effectively remaining at the locations shown in FIG. 4 by introducing beam reflecting devices such as mirrors and beamsplitters into principal radiation path 44. As shown in FIGS. 2 and 3, beamsplitters can be used to create a plurality of paths such as the three paths with portions indicated by 44*a*, 44*b*, and 44*c*, respectively, and a corresponding plurality of focal points Fa, Fb, and Fc. Each of principal radiation paths 44*a*, 44*b*, and 44*c*, together with a corresponding portion of path 44, e.g., between secondary reflector 46 and beam reflecting means 58, 82 and 90, respectively, have a path length substantially equal to the path length of principal radiation path 44 as shown in FIG. 4, and each of focal points Fa, Fb, and Fc lie at effectively the same location as focal point F. These alternative path and focal point locations may be employed in the preferred embodiment, as will be more fully described below.

Tester head 12 includes first radiation source means positioned effectively in principal radiation path 44 for generating a target beam 50 of the first radiation (as described above) and for directing target beam 50 along principal radiation path 44 sequentially to the secondary reflecting means, to the primary reflecting means, and to the sensor of the E-O system along the path described above for the target projection mode. Since the sensor in this illustrative example includes a FLIR, the radiation source means preferably comprises an infrared blackbody source 52. Target beam 50 generated by infrared blackbody source 52 and directed to the FLIR via the main optic causes the FLIR of E-O system 32 to set the direction of the target vector in substantial correspondence with target beam 50. The setting of the target vector may comprise identifying the location of the target on a focal plane or mosaic of the FLIR and calculating a corresponding target vector direction. Of course, a defective or misaligned FLIR may fail to precisely set the target vector in accordance with target beam 50, which may be detected by controller 14 via interface box 34 (FIG. 1).

Preferably, infrared blackbody source 52 is spaced from principal radiation path 44 so that target beam 50 is projected from infrared blackbody source 52 along path 44/44*a*, as shown in FIGS. 2 and 3. Beam reflecting means, such as a movable or rotatable mirror 54, receives target beam 50 from source 52 and reflects essentially 100% of the beam along path 44*a* through a beam defining means positioned in principal radiation path 44*a* about focal point Fa in the focal plane of the main optic, such as FLIR target 56, and onto beam reflecting means such as beamsplitter 58 which is positioned in principal radiation path 44. Beamsplitter 58 then reflects target beam 50 along principal radiation path 44 to secondary reflector 46.

Figure 6:
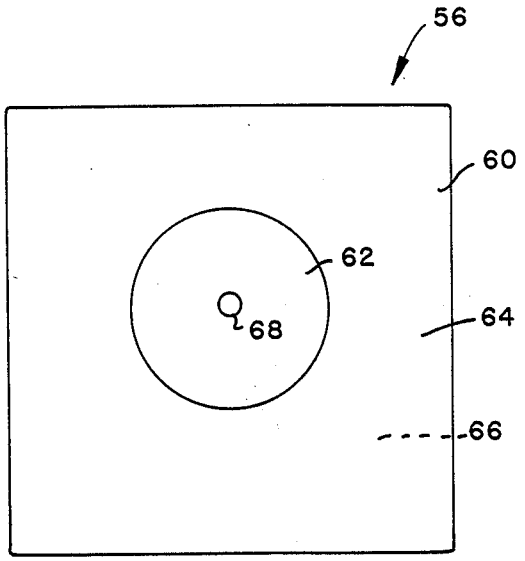
FIG. 6 is a diagram of a FLIR target mounted in the tester head shown in FIGS. 2 and 3.

FLIR target 56 restricts target beam 50 into a relatively small area of the focal plane to provide the FLIR with a specific range of target angle corresponding to a size of a target signature. With reference to FIG. 6, FLIR target 56 comprises a plate 60 surrounding an aperture 62. Plate 60 is opaque to the first, second and third radiations. The surface 64 of plate 60 facing beamsplitter 58 has high emissivity, and the surface 66 facing rotatable mirror 54 has low emissivity. This allows surface 64 of plate 60 to emit blackbody radiation that corresponds to the ambient temperature of plate 60 while avoiding absorption of radiation from infrared blackbody source 52 at surface 66, which would tend to raise that ambient temperature.

Aperture 62 comprises a disc of material suitable to pass both the first and third radiations, such as zinc selenide. A small spot 68 which is opaque to both the first and third radiations is located in the center of the disc. Spot 68 provides a shadow image for internal alignment of the preferred embodiment, as will be described in detail below.

Proper operation of infrared blackbody source 52 and FLIR target 54 are dependent upon maintaining these elements under relatively stable conditions, e.g., temperature and humidity. Preferably, a predetermined temperature differential is maintained between source 52 and its surroundings. For example, test aperture 12', mirror 54, and FLIR target 56 are all at ambient temperature while infrared blackbody source 52 can be accurately driven to a temperature from 0° to 25° centigrade above this ambient temperature. Thus, sufficient energy is available from source 52 for FLIR testing between 8- and 14-micron wavelengths. In addition, mirror 54 and FLIR target 56 are environmentally protected and controlled using a window 70 (FIGS. 2 and 3) constructed of a material that allows passage of the first and third radiations.

In accordance with the boresight measurement mode, the preferred embodiment includes detecting means positioned effectively in principal radiation path 44 at or near focal point F of the focal plane and responsive to the second radiation for detecting the location of the illumination beam relative to the location of the target vector as determined using a reference value from the internal alignment mode. The detecting means of the preferred embodiment includes a detector matrix 80 responsive to laser light of the type projected by the laser designator of E-O system 32. A number of commercially available detectors are suitable for use as detector matrix 80, as would be readily known to one of ordinary skill in the art. Detector matrix 80 is positioned effectively at or near focal point F, which corresponds to the location of infrared blackbody source 52 and, thus, to the location of the target image produced by tester head 12 and viewed by the FLIR of E-O system 32. Although detector matrix 80 may be positioned directly in principal radiation path 44, preferably it is spaced from path 44, and is positioned at a location corresponding to focal point Fb along path 44*b*. Tester head 12 includes beam reflecting means such as beamsplitter 82 positioned in principal radiation path 44 for reflecting the illumination beam from principal radiation path 44 to detector matrix 80.

The detecting means preferably includes beam attenuating means, such as variable density attenuator/filter 84, positioned between secondary reflector 46 and detector matrix 80 for attenuating the illumination beam. Attenuator/filter 84 reduces the intensity of the illumination beam to avoid saturating or damaging sensitive components of detector matrix 80, and to maintain a desired signal level on detector matrix 80. In the embodiment depicted here, the degree of attenuation is controllable via the relative position of two wedges 84*a* and 84*b*. For example, wedge 84*a* is moved from right to left in FIG. 3 to increase attenuation, which can be done manually or via motorized computer control.

The detecting means also preferably include a fast detector 86 positioned effectively in principal radiation path 44 and coupled to detector matrix 80 for triggering detector matrix 80 in response to the illumination beam. Fast detector 86 preferably includes diffusing means, such as diffuser 88, positioned effectively in principal radiation path 44 at focal point F of the main optic focal plane for diffusing the illumination beam to make fast detector 86 independent of the exact location or focal point of the illumination beam. Fast detector 86 and diffuser 88 preferably are spaced from principal radiation path 44 in path 44*c* and diffuser 88 is positioned at a location corresponding to focal point Fc, as shown in FIGS. 2 and 3. Accordingly, the detecting means include beam reflecting means, such as mirror 90, positioned in principal radiation path 44 for reflecting the illumination beam from principal radiation path 44 to fast detector 86. Attenuator/filter 84 is positioned between secondary reflector 46 and beamsplitter 82.

During the internal alignment mode, a relative measurement is made that establishes an alignment reference between the target beam and a location on detector matrix 80. This is done by assigning the location on detector matrix 80 corresponding to the target image as the zero point or origin of detector matrix 80. To accomplish this function, the preferred embodiment of the invention includes internal alignment means for establishing the relative location of the radiation source means with repect to the detecting means. The internal alignment means includes internal alignment radiation source means effectively positioned in principal radiation path 44 for generating an internal alignment beam 100 of a third radiation to which detector matrix 80 and fast detector 86 respond, and for directing internal alignment beam 100 substantially along principal radiation path 44. The internal alignment radiation source means preferably comprises an internal alignment beam source 102 such as an inert gas arc lamp of conventional design having an aperture 102' positioned to direct internal alignment beam toward the main optic along principal radiation path 44.

In accordance with the preferred embodiment, internal alignment beam source 102 is spaced from principal radiation path 44 and is aligned with rotatable mirror 54 so that aperture 102' of internal alignment beam source 102 is aligned with aperture 62 and, therefore, is perpendicular to and passes substantially through rotation axis 54'. Internal alignment beam source 102 directs internal alignment beam 100 to rotatable mirror 54, which directs the beam through aperture 62, where it picks up a shadow image of spot 68, and then to beamsplitter 58 along path 44*a*. Beamsplitter 58 reflects internal alignment beam 100 along path 44 toward secondary reflector 46. Thus, rotatable mirror 54 reflects in the alternative (1) target beam 50 from infrared blackbody radiation source 52 to beamsplitter 58 and (2) internal alignment beam 100 from internal alignment beam source 102 to beamsplitter 58.

Beamsplitter 58 reflects a substantial portion of internal alignment beam 100 to secondary reflector 46, which reflects the beam to principal reflector 40. Principal reflector 40 reflects beam 100 toward aperture 12' and secondary reflector 46.

To facilitate internal alignment using this reflected portion of beam 100, tester head 12 preferably includes retro-reflecting means positioned substantially along principal radiation path 44 and preferably adjacent to secondary reflector 46 for receiving internal alignment beam 100 from primary reflector 40 and reflecting this beam sequentially back to primary reflector 40, which reflects beam 100 back to secondary reflector 46. Secondary reflector 46 reflects beam 100 substantially along principal radiation path 44 to the detecting means. The retro-reflecting means of the preferred embodiment includes a cube corner reflector 106 of conventional design. The position of retro-reflector 106 is given here by way of illustration and not limitation. Retro-reflector 106 may alternatively be positioned in a number of different locations and perform the functions described above, as would be readily understood by one having ordinary skill in the art.

As noted above, the main optic performs this function regardless of the position of E-O system 32 relative to tester head 12. Thus, internal alignment beam follows a path similar to the paths followed by the target and illumination beams and also impinges upon retro-reflector 106. Retro-reflector 106 reflects the beam back the primary reflector 40, which reflects it to secondary reflector 46. Secondary reflector 46 reflects beam 100 along paths 44/44*b* and 44/44*c* to detector matrix 80 and fast detector 86, respectively. This is in accordance with the principal property of retro-reflectors that an incident beam will be reflected exactly parallel to itself (within the angular accuracy tolerance of retro-reflector manufacture) regardless of its angle of incidence relative to the retro-reflector. Mounting accuracy of retro-reflector 104 is thus not critical.

The preferred embodiment may also include control means such as controller 14 and computer 18 coupled to detector matrix 80 for receiving the data obtained during the internal alignment and boresight measurement modes and calculating the location of the illumination beam relative to the location and direction of the target vector or, more precisely, relative to the position of internal alignment beam 100. Controller 14 and computer 18 may include conventional microprocessors or central processing units with appropriate interface circuitry for interfacing with detector matrix 80.

The operation of the preferred embodiment of the invention will now be described to illustrate the preferred method of the invention. With reference to FIG. 1, E-O system 32 to be tested is mounted at the center of plane 24 of motion table 22. Tester head 12 is mounted on outer gimbal arm 26 of motion table 22 corresponding to zero azimuth and elevation. Motion table 22 is at its reference or equilibrium position, and optical aperture 32' is aligned with and faces test aperture 12' of tester head 12.

The internal alignment mode of the preferred method is performed as a first step. The internal alignment mode in accordance with the preferred method includes generating an internal alignment beam, e.g., internal alignment beam 100; directing internal alignment beam 100 substantially along a principal radiation path, e.g., path 44/44*a*, sequentially to a secondary reflecting zone, e.g. at secondary reflector 46, to a primary reflecting zone, e.g., primary reflector 40, to a retroreflector zone, e.g., retroreflector 106, back to the primary reflecting zone, back to the secondary reflecting zone, and substantially along principal radiation path 44 to a detector location, e.g., along path 44/44*b* to detector matrix 80; and detecting the location of the image of spot 68 within internal alignment beam 100 at the detector location to establish a reference location at the detector for the target beam.

Figure 7:
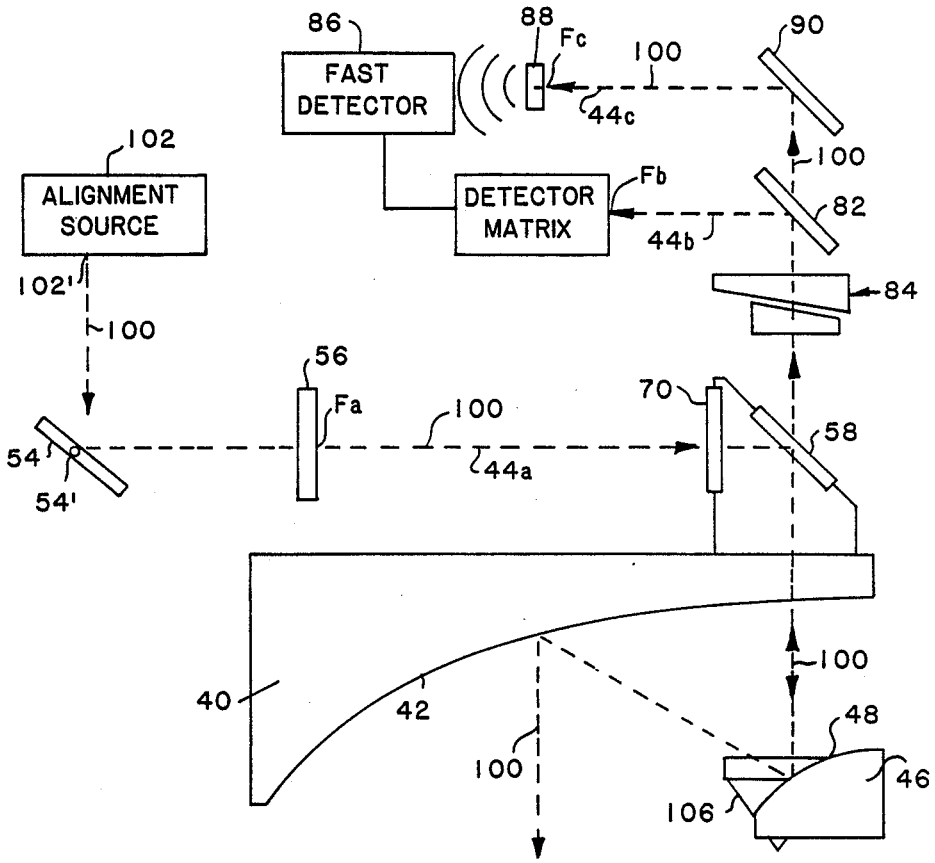
FIG. 7 is a diagram of selected components of the tester head shown in FIGS. 2 and 3 which illustrates the internal alignment mode of the preferred method.

With reference to FIG. 7, rotating mirror 54 is positioned to face internal alignment radiation source 102 and source 102 is energized. The resulting internal alignment beam 100 is reflected from mirror 54 to back-illuminate FLIR target 56. The energy of beam 100 fills aperture 62 of FLIR target 56 and forms a shadow image of opaque spot 68. This shadow image serves as an internal alignment reference position for the detecting means. Incidentally, the shadow image is also present in the target projection mode, but it is too small to be seen by the FLIR.

Internal alignment beam 100, which includes the shadow image, is projected through window 70 and onto beamsplitter 58, where some of the energy is transmitted and lost, but a sufficient fraction is reflected onto secondary reflector 46 and primary reflector 40 of the main optic (FIG. 4). These elements collimate internal alignment beam 100 and a fraction of the collimated energy is directed to retro-reflector 106. Retroreflector 106 reflects this energy back through the main optic (i.e., sequentially to primary reflector 40 and to secondary reflector 46) where the beam is focused. Secondary reflector 46 returns the beam to beamsplitter 58. A portion of this returned internal alignment beam energy passes through beamsplitter 58 and through attenuator/filter 84. This slightly attenuated energy is then divided by beamsplitter 82 where a portion is reflected onto detector matrix 80 effectively at or near focal point F.

Thus, an image of the internal alignment beam spot reference of FLIR target 56 appears sharply focused at some position on the detector matrix 80. This linear position depends upon the angular position of the image of aperture 62 of FLIR target 56. The physical coordinates of the centroid of this image on detector matrix 80 are electronically calculated, e.g., by computer 18 in FIG. 1, and stored as a FLIR projection centroid reference. This position is then used in the boresight measurement mode to represent a reference value for the location of the target beam relative to a precise location on the detector matrix, this reference location corresponding to the desired position of the centroid of the illumination beam for a properly aligned E-O system. Thus, internal alignment beam 100 and infrared radiation of target beam 50 both pass through the same optical elements and both are collimated by the same main optic, i.e., primary and secondary reflectors 40 and 46. Accordingly, internal alignment beam 100 follows essentially the same path as the illumination beam.

Upon completing the internal alignment mode, the target projection mode is performed during which a target signature is projected toward the E-O system under test to set the direction of the target vector of the FLIR. Accordingly, the preferred method of the invention includes generating a target beam of the first radiation and directing the target beam along the principal radiation path to a secondary reflecting zone, reflecting the target beam at the secondary reflecting zone to a primary reflecting zone, and reflecting the target beam at the primary reflecting zone to the sensor of the E-O system under test which, as described in detail above, causes the sensor of the E-O system to set the direction of the target vector in substantial correspondence with the target beam.

As described above with regard to the position of infrared blackbody source 52, generation of the target beam may occur away from but directed toward the principal radiation path, in which case the target beam is reflected to and along the principal radiation path at the principal radiation path, for example, by beamsplitter 58. Preferably, the method includes shaping or defining the target beam about focal point F or its equivalent, as is done, for example, by FLIR target 56.

Figure 8:
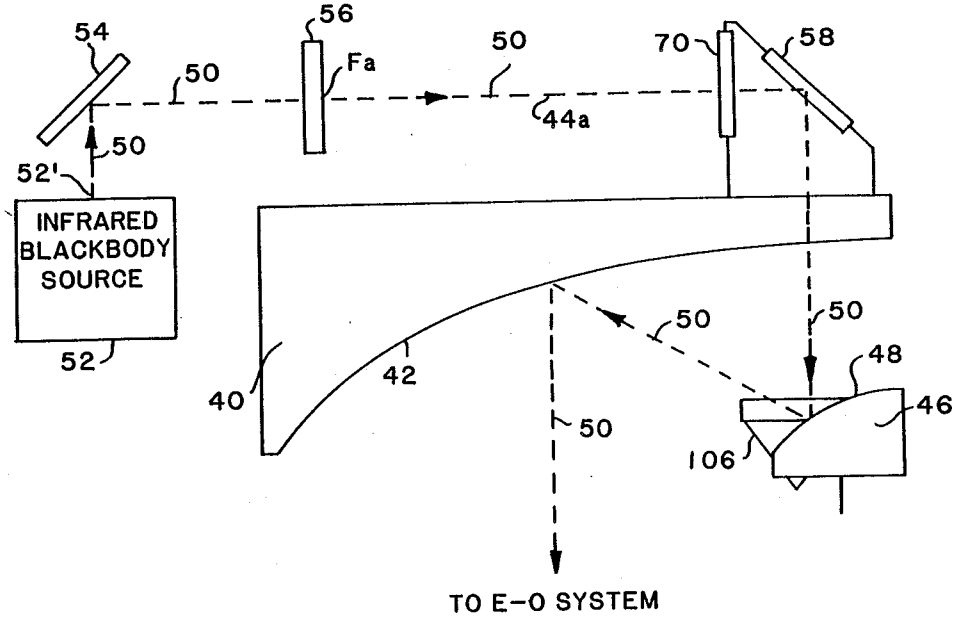
FIG. 8 is a diagram of selected components of the tester head shown in FIGS. 2 and 3 which illustrates the target projection mode of the preferred method.

With reference to FIG. 8, infrared radiation of target beam 50 from blackbody source 52 passes through aperture 62 of FLIR target 56 where it is joined by infrared radiation from plate 60 of FLIR target 56. Target beam 50 passes through window 70 and is reflected by beamsplitter 58, which acts as a plane mirror at the 8- to 14-micron wavelength band. Target beam 50 is directed by beamsplitter 58 to secondary reflector 46 and primary reflector 40, which collimate the radiation as an image of FLIR target 56 and project it to the FLIR of E-O system 32. The FLIR perceives an image of aperture 62 as if the image were at a great distance and can "lock-on" to this image and track it as tester head 12 moves relative to E-O system 32 on motion table 22. Thus, during the target projection mode, the apparatus of the present invention sets the direction of the target vector of the sensor in accordance with the target signature generated by infrared blackbody source 52, even when E-O system 32 is moving relative to tester head 32.

E-O system 32 also responds by generating an illumination beam of the second radiation (e.g., monochromatic laser light) and directing the illumination beam to the target as designated by the target vector. When properly aligned, the illumination beam will coincide with the target vector at the location of the target, which in this test-related example is focal point F or its equivalent.

After the target vector has been set during the target projection mode and the laser designator of E-O system 32 has projected the illumination beam into aperture 12' of tester head 12, the preferred apparatus and method of the invention are adapted to enter the boresight measurement mode during which the location of the illumination beam relative to the target vector is detected. Accordingly, the preferred method includes reflecting the illumination beam received from E-O system 32 at the primary reflecting zone to the secondary reflecting zone, reflecting the illumination beam at the secondary reflecting zone to a detector location along the principal radiation path, and detecting the location of the illumination beam relative to the location of the target vector at the detector location. Preferably, detection of the illumination beam occurs away from principal radiation path 44 and includes reflecting the illumination beam from principal radiation path 44 to the detector location, for example, at detector matrix 80 using beamsplitter 82. The method may include attenuating the illumination beam prior to detecting the location of the illumination beam, for example, using attenuator/filter 84. Detection of the illumination beam may also include triggering detector matrix 80 in response to the illumination beam, for example, using fast detector 86. The illumination beam may be diffused to make the triggering independent of the exact location of the illumination beam within path 44.

Figure 9:
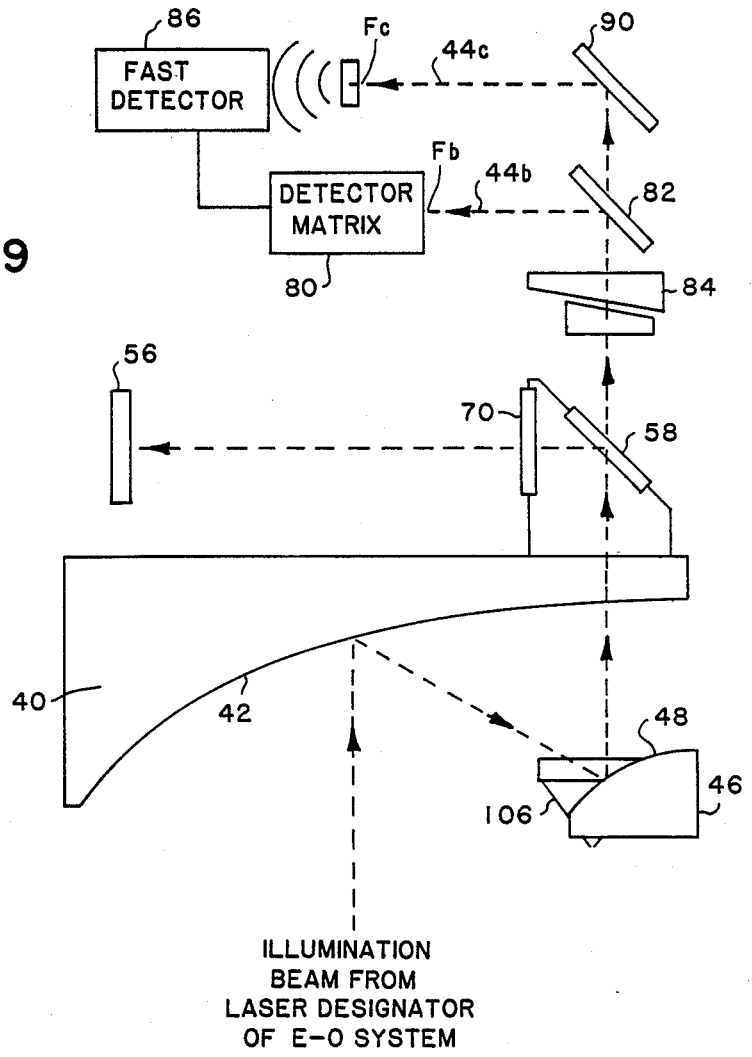
FIG. 9 is a diagram of selected components of the tester head shown in FIGS. 2 and 3 which illustrates the boresight measurement mode of the preferred method.

With reference to FIG. 9, the illumination beam projected from the laser designator of E-O system 32 impinges upon primary reflector surface 42 and secondary reflector surface 48 of the main optic, which focus the energy of the beam through tester head 12 to focal point F. A small portion of the energy reflects off beamsplitter 58 and is further attenuated by the window 70 to avoid damaging opaque spot 68. The illumination beam passes through beamsplitter 58 and into attenuator/filter 84 where it is selectively attenuated.

The attenuated laser energy next impinges beamsplitter 82, where a portion is reflected into detector matrix 80 at focal point Fb of the main optic. The remainder of the illumination beam passes through beamsplitter 82 to mirror 90, which directs it into diffuser 88. The defocused and diffuse laser energy then falls on fast detector 86 which "triggers" detector matrix 80 to download a frame of data. Data from detector matrix 80 are then used, for example, in computer 18 of FIG. 1, to calculate the centroid position of the illumination beam relative to the position of the target vector as represented by the previously stored internal alignment beam (centroid reference). Computer 18 then calculates the boresight alignment between FLIR and laser in E-O system 32 from this comparison.

Once the illumination beam has been properly attenuated and directed to detector matrix 80 and fast detector 86, the apparatus and method of the invention may use the resulting data to perform a number of functions in addition to those described above. For example, several output parameters of the laser designator can be measured. These may include pulse timing information such as pulse width and pattern repetition, and beam quality characteristics such as energy profile and divergence angle. A relative measure of beam intensity is also possible and, by adding a calibrated calorimeter, accurate amplitude measurements can be made. Modifications to the preferred embodiment could also be made to test laser receivers in E-O system 32.

The preferred apparatus and method described here provide a number of significant advantages over prior art devices. For example, the internal alignment mode and corresponding apparatus enable precision dynamic testing of an E-O system while overcoming the limitations of prior art devices which require a physical or structural alignment reference point.

Additional advantages and modifications will readily occur to those skilled in the art. For example, frequency ranges in the electromagnetic spectrum other than those described could be used. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. An apparatus for static and dynamic testing of the boresight alignment of an electro-optic system having a line-of-sight sensor responsive to first radiation from a target for sensing the location of the target and setting the direction of a target vector to correspond to the location of the target, and a line-of-sight illuminator for directing an illumination beam of second radiation at the located target, the boresight alignment being the extent to which the target vector and the illumination beam have achieved a predetermined angular relationship, said apparatus comprising:

a main optic optically coupled to the electro-optic system and aligned with a principal radiation path for receiving the second radiation from the electro-optic system and focusing the second radiation about a focal point in a focal plane substantially perpendicular to said principal radiation path, said main optic including a primary reflector for reflecting the first and the second radiations between the electro-optic system and a subreflector zone, and a secondary reflector positioned in said subreflector zone and spaced from said primary reflector for reflecting the first and second radiations between said primary reflector and said focal plane along said principal radiation path;

first radiation source means positioned effectively in said principal radiation path for generating a target beam of the first radiation and for directing said target beam along said principal radiation path sequentially to said secondary reflector, to said primary reflector, and to the sensor of the electro-optic system, said target beam causing the sensor to set the direction of the target vector in substantial correspondence with said target beam; and detecting means positioned effectively in said focal plane and in said principal radiation path and responsive to the second radiation for detecting the location of the illumination beam relative to the location of the target vector.

2. An apparatus as recited in claim 1, wherein said primary reflector reflects said first and second radiations between the electro-optic system and said subreflector zone for a plurality of locations of said apparatus relative to the electro-optic system.

3. An apparatus as recited in claim 1, wherein said primary reflector comprises a reflecting surface having surface geometry $z_1$ along a z-axis according to $$z_2 = \frac{p^2/r_2^2}{1 + \sqrt{1 - (1 + \Delta_2)(p^2/r_2^2)}}$$

where $p^2 = x^2 + y^2$, $r_1 = -22.409$, $\Delta_1 = -1$, and x, y and z are the three axes of a rectilinear coordinate system.

4. An apparatus as recited in claim 1, wherein said secondary reflector reflects the first and second radiations between said primary reflector and said principal radiation path for a plurality of locations of said apparatus relative to the electro-optic system.

5. An apparatus as recited in claim 1, wherein said secondary reflector comprises a reflecting surface having surface geometry $z_2$ along a z-axis according to $$z_1 = \frac{p^2/r_1^2}{1 + \sqrt{1 - (1 + \Delta_1)(p^2/r_1^2)}}$$

where $p^2 = x^2 + y^2$, $r_2 = -7.272$, $\Delta_2 = -1.6112155$, and x, y and z are the three axes of a rectilinear coordinate system.

6. An apparatus as recited in claim 1, wherein said first radiation source means includes an infrared radiation source.

7. An apparatus as recited in claim 1, wherein said first radiation source means includes an infrared radiation source spaced from said principal radiation path, and a first beam reflecting means positioned in said principal radiation path for reflecting said target beam from said infrared radiation source to said secondary reflector along said principal radiation path.

8. An apparatus as recited in claim 1, wherein said first radiation source means includes beam defining means positioned effectively in said focal plane and in said principal radiation path for defining said target beam.

9. An apparatus as recited in claim 8, wherein said beam defining means comprises a surface having an aperture, said surface being substantially opaque and said aperture being substantially transparent to the first radiation.

10. An apparatus as recited in claim 1, wherein said detecting means includes a detector matrix effectively positioned in said principal radiation path and responsive to the second radiation for detecting the direction of the illumination beam relative to the target vector.

11. An apparatus as recited in claim 10, wherein said detector matrix is spaced from said principal radiation path, and said detecting means includes second beam reflecting means positioned in said principal radiation path for reflecting the illumination beam from said principal radiation path to said detector matrix.

12. An apparatus as recited in claim 10, wherein said detecting means includes a fast detector positioned effectively in said principal radiation path and coupled to said detector matrix for triggering said detector matrix in response to said illumination beam.

13. An apparatus as recited in claim 12, wherein said detecting means includes diffusing means positioned effectively in said principal radiation path between said secondary reflector and said fast detector for diffusing the illumination beam to make said triggering of said fast detector independent of the exact location of the illumination beam.

14. An apparatus as recited in claim 12, wherein said fast detector is spaced from said principal radiation path, and said detecting means includes third beam reflecting means positioned in said principal radiation path for reflecting said illumination beam from said principal radiation path to said fast detector.

15. An apparatus as recited in claim 12, wherein said detecting means includes beam attenuation means positioned between said secondary reflector and at least one of said detector matrix and said fast detector for attenuating the illumination beam.

16. An apparatus as recited in claim 1, further including internal alignment means for aligning said first radiation source means with said detecting means, said internal alignment means including internal alignment radiation source means effectively positioned in said principal radiation path for generating an internal alignment beam of a third radiation to which said detecting means responds and for directing said internal alignment beam substantially along said principal radiation path sequentially to said secondary reflector and to said primary reflector, and retro-reflector means positioned substantially in said principal radiation path for receiving said internal alignment beam from said primary reflector and reflecting said internal alignment beam sequentially to said primary reflector, to said secondary reflector, and substantially along said principal radiation path to said detecting means.

17. An apparatus as recited in claim 16, wherein said first radiation source means includes beam defining means positioned effectively in said focal plane and in said principal radiation path between said internal alignment radiation source and said secondary reflector for defining said target beam, said beam defining means including a surface having an aperture with a spot positioned in said aperture, said surface and said spot being substantially opaque and said aperture other than said spot being substantially transparent to the first and third radiations.

18. An apparatus as recited in claim 7, further including internal alignment means for aligning said radiation source means with said detecting means, said internal alignment means including internal alignment radiation source means spaced from said principal radiation path for generating an internal alignment beam of a third radiation to which said detecting means responds and for directing said internal alignment beam to said first beam reflecting means, said first beam reflecting means reflecting said internal alignment beam substantially along said principal radiation path sequentially to said secondary reflector and to said primary reflector, and retro-reflector means positioned substantially along said principal radiation path for receiving said internal alignment beam from said primary reflector and reflecting said internal alignment beam sequentially to said primary reflector, to said secondary reflector, and substantially along said principal radiation path to said detecting means.

19. An apparatus as recited in claim 18, wherein said first radiation source means includes beam defining means positioned effectively in said focal plane and in said principal radiation path between said internal alignment radiation source and said secondary reflector for defining said target beam, said beam defining means including a surface having an aperture with a spot positioned in said aperture, said surface and said spot being substantially opaque and said aperture other than said spot being substantially transparent to the first and third radiations.

20. An apparatus as recited in claim 18, wherein said apparatus includes fourth beam reflecting means spaced from said principal radiation path and from said first beam reflecting means for reflecting in the alternative (1) said target beam from said first radiation source to said first beam reflecting means and (2) said internal alignment beam from said internal alignment radiation source means to said first beam reflecting means.

21. An apparatus as recited in claim 20, wherein said fourth beam reflecting means comprises a movable mirror.

22. A method for static and dynamic testing of the boresight alignment of an electro-optic system having a line-of-sight sensor responsive to first radiation from a target for sensing the location of the target and setting the direction of a target vector to correspond to the location of the target, and a line-of-sight illuminator for directing an illumination beam of second radiation at the located target, the boresight alignment being the extent to which the target vector and the illumination beam have achieved a predetermined angular relationship, said method comprising:

generating a target beam of the first radiation defined by an aperture in a focal plane and directing said target beam along a principal radiation path substantially perpendicular to said focal plane to a secondary reflector, reflecting said target beam at said secondary reflector to a primary reflector, and reflecting said target beam at said primary reflector to the sensor of the electro-optic system, said primary and secondary reflectors collimating said target beam, said target beam causing the sensor to set the direction of the target vector in substantial correspondence with said target beam; and reflecting the illumination beam at said primary reflector to said secondary reflector, reflecting the illumination beam at said secondary reflector to a detector positioned in said focal plane along said principal radiation path, said primary and secondary reflectors focusing said illumination beam, and detecting the location of the illumination beam relative to the location of the target vector at said detector.

23. A method as recited in claim 22, further including:

generating an internal alignment beam including a spot image and directing said internal alignment beam substantially along said principal radiation path through said aperture sequentially to said secondary reflector, to said primary reflector, to a retro-reflector, to said primary reflector, to said secondary reflector, and substantially along said principal radiation path to said detector; and detecting the location of said spot image contained in said internal alignment beam at said detector to align said detector with said target beam.

* * * * *

UNITED STATES PATENT AND TRADEMARK OFFICE

CERTIFICATE OF CORRECTION

PATENT NO. : 4,917,490

DATED : April 17, 1990

INVENTOR(S) : JAMES R. SCHAFFER, JR., ET AL.

It is certified that error appears in the above-identified patent and that said Letters Patent is hereby corrected as shown below:

Column 16, line 57, change "$r_2$" (both occurrences) to --$r_1$--.

Column 17, line 4, change "$r_1$" to --$r_2$--.

Column 17, line 4, "1)" should read -- 2) --.

Signed and Sealed this

Sixteenth Day of April, 1991

*Attest:*

*Attesting Officer*

HARRY F. MANBECK, JR.

*Commissioner of Patents and Trademarks*